US007102279B2

(12) United States Patent
Cheng et al.

(10) Patent No.: US 7,102,279 B2
(45) Date of Patent: Sep. 5, 2006

(54) FED WITH INSULATING SUPPORTING DEVICE HAVING REFLECTION LAYER

(75) Inventors: Kuei-Wen Cheng, Taipei (TW); Shie-Heng Lee, Taipei (TW)

(73) Assignee: Teco Nanotech Co., Ltd., Taipei (TW)

( * ) Notice: Subject to any disclaimer, the term of this patent is extended or adjusted under 35 U.S.C. 154(b) by 0 days.

(21) Appl. No.: 10/879,018

(22) Filed: Jun. 30, 2004

(65) Prior Publication Data

US 2006/0001355 A1 Jan. 5, 2006

(51) Int. Cl.
*H01J 1/62* (2006.01)
*H01J 63/04* (2006.01)

(52) U.S. Cl. ..... 313/497; 313/292; 313/309; 313/336; 313/351

(58) Field of Classification Search ..... 313/495–497, 313/292, 309, 336, 351, 113, 114
See application file for complete search history.

(56) References Cited

U.S. PATENT DOCUMENTS 6,417,616 B1 * 7/2002 Lee ..... 313/495
6,858,980 B1 * 2/2005 Kamiguchi ..... 313/495
2004/0174114 A1 * 9/2004 Ohishi et al. ..... 313/495

OTHER PUBLICATIONS

O. Gröning, et al. "Resistor limited electron field emission in regular oriented carbon nanotube arrays" LITHO (oral), Jun. 2004.*

* cited by examiner

*Primary Examiner*—Ashok Patel
(74) *Attorney, Agent, or Firm*—Troxell Law Office, PLLC

(57) ABSTRACT

An FED has a cathode, an anode and an insulating supporting device. The cathode has a plurality of cathode electron emitter layers and a cathode substrate. The cathode has a plurality of cathode ribs disposed on the cathode substrate, and the cathode ribs are used for laterally separating any respective two cathode ribs. The anode has a phosphors layer and an anode substrate. The insulating supporting device is arranged between the cathode ribs and the anode, and has a reflection layer facing the anode and a gate made of a conductive material and disposed above the cathode ribs. The reflection layer is capable of reflecting light emitted from the phosphors layer.

7 Claims, 5 Drawing Sheets

FED WITH INSULATING SUPPORTING DEVICE HAVING REFLECTION LAYER

BACKGROUND OF THE INVENTION

1. Field of the Invention

The present invention relates to an FED, and particularly relates to an FED including an insulating supporting device with a reflection layer.

2. Background of the Invention

There are several categories of a flat panel display (FPD), such as, for example, a field emission display (FED), a thin film transistor-liquid crystal display (TFT-LCD), a plasma display panel (PDP), an organic electro-luminescence display (OELD), or a reflection-type liquid crystal display (LCD). Thinness, lightness, low power consumption, and portability are the common features of the FEDs mentioned above. The FED has many similarities with conventional cathode ray tubes (CRT). As for the CRT, electrons are accelerated in a vacuum towards phosphors, which then glows. The main difference with the CRT is that the electrons are generated by field emission rather than thermal emission, so the device consumes much less power and can be turned on instantly. Instead of one single electron gun, each pixel includes several thousands of sub-micrometer or even nanometer tips from which electrons are emitted. The tips, made of low work-function materials, and in particular of carbon nanotubes (CNTs) nowadays, are sharp, so that the local field strengths become high enough for even a moderately low gate voltage.

A conventional FED illustrated in FIG. 1 includes a unit within an anode 10*a* and a cathode 20*a* disposed therein, and an insulating supporting member 15*a* (or a spacer) arranged between the anode 10*a* and the cathode 20*a* for separating the anode 10*a* from the cathode 10*a* and supporting the anode 10*a*. The anode 10*a* includes an anode glass substrate 11*a*, an anode conductive layer 12*a*, and a phosphors layer 13*a* arranged sequentially. The cathode 20*a* includes a cathode glass substrate 21*a*, a cathode electrode layer 22*a*, a cathode electron emitter layer 23*a*, a dielectric layer 24*a*, and a gate layer 25*a* arranged sequentially. The insulating supporting member 15*a* is connected between the anode 10*a* and the cathode 10*a* for support. The cathode electron emitter layer 13*a* generates electrons for emission onto the phosphors layer 13*a* to produce light via an additional electric field, so as to excite the phosphors layer 13*a* to luminesce. Furthermore, the cathode electrode layer 22*a* is made from cathode conductive lines parallel to one another, and the gate layer 25*a* is made from gate conductive lines parallel to one another. The gate conductive lines are orthogonal to the cathode conductive lines. In addition, an additional voltage is forced between the gate layer 25*a* and the cathode electrode layer 22*a*. An electron beam provided by the gate layer is controlled to switch due to the orthogonal arrangement between the gate conductive lines and the cathode conductive lines. For ease of moving the electrons, a vacuum of $10^{-7}$ Torr is accordingly formed therein, a mean free path of the electrons is provided, and, furthermore, the vacuum protects the cathode electron emitter layer 223*a* and the phosphors layer 13*a* from pollution. In order to accelerate the electrons for impact, there should be a proper distance between the anode 10*a* and the cathode 20*a*. After the anode 10*a*, including the anode conductive layer 12*a* and the phosphors layer 13*a*, is provided with the high power, the electron beam is energized enough to excite the phosphors.

However, conventional methods make the conventional FED still hard to mass-produce due to the complicated procedures and the precise fabrications, especially for displays with large sizes. Other conventional methods using a thick film technology can be used for large size displays, but still do not provide high resolution. In addition, the relative pastes and materials are hard to implant.

In recent years, a new insulating supporting member is shaped of a panel as a rib. Referring to FIG. 1, an expansion coefficient of this material is similar to that of glass. The thickness of the plate-like device ranges from 500 μm to 1500 μm, and the plate-like device has a plurality of apertures 42' etched therein. A diameter of each aperture 42' can meet the FED unit (including the anode and the cathode). The plate-like device is used for a support. The conventional supporting member is shaped as a glass ball, a cross, or a strip via an adhesive stuck thereto in advance. After a sintering process, a plate-like device is made thereby. The supporting member has a size ranging from 50 μm to 200 μm. Because of the micro size, the plate-like device encounters some problems in manufacture. First, the manufacturing process is complicated. The equipment needs more precision due to the micro size. Second, the plate-like device sticky with the adhesive is polluted easily; because the conventional plate-like device uses the adhesive to connect to a panel and a sintering process is required, the adhesive easily pollutes the panel. Third after the sintering process, the solvent contained in the adhesive will escape therefrom to pollute the panel.

Hence, an improvement over the prior art is required to overcome the disadvantages thereof.

SUMMARY OF INVENTION

The primary object of the invention is therefore to specify an FED that can manufacture the gate above an insulating supporting device with a reflection layer thereof via a simple process. The secondary object of the invention is therefore to specify an FED of which an insulating supporting device is manufactured individually to save costs.

The third object of the invention is therefore to specify an FED for which elements individually made in advance are assembled in simple steps.

The object is achieved by an FED including a cathode, an anode and an insulating supporting device. The cathode has a plurality of cathode electron emitter layers and a cathode substrate, where the cathode includes a plurality of cathode ribs disposed on the cathode substrate, and the cathode ribs are used for laterally separating any respective two cathode ribs. The anode has a phosphors layer and an anode substrate. The insulating supporting device is arranged between the cathode ribs and the anode, and has a reflection layer facing the anode and a gate made of a conductive material and disposed above the cathode ribs. The reflection layer is capable of reflecting the light emitted from the phosphors layer.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

Figure 4:
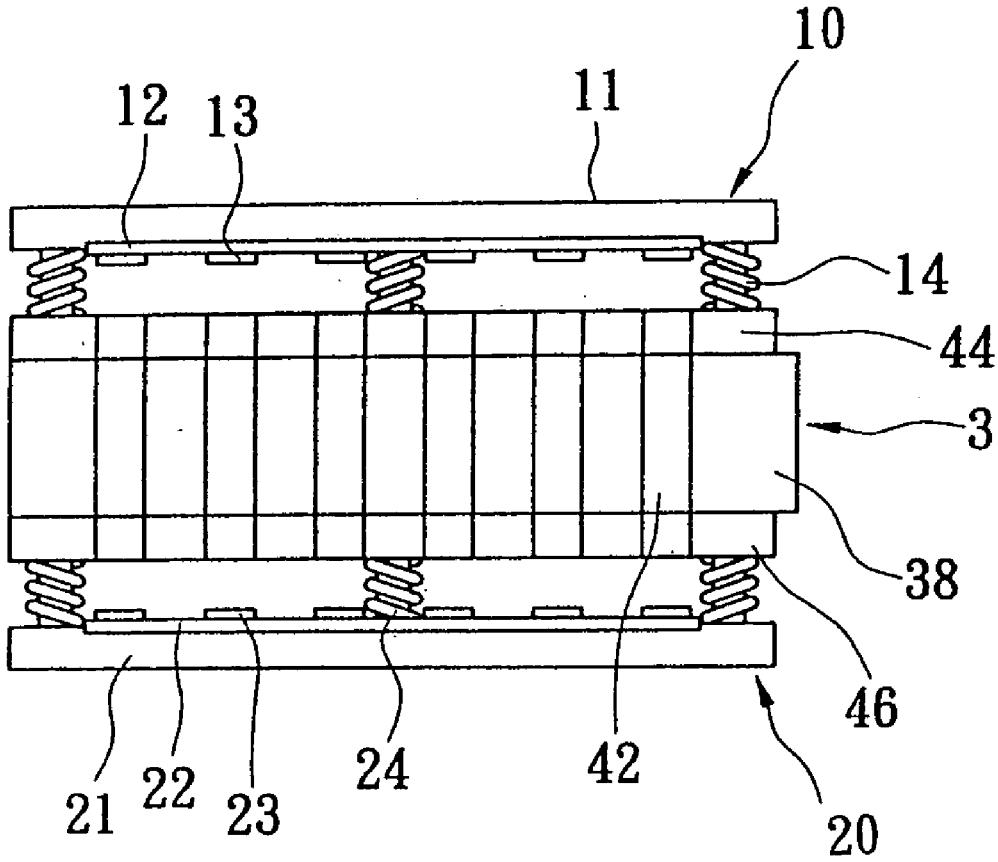
FIG. 4 is a perspective view of an FED according to the present invention.
Figure 5:
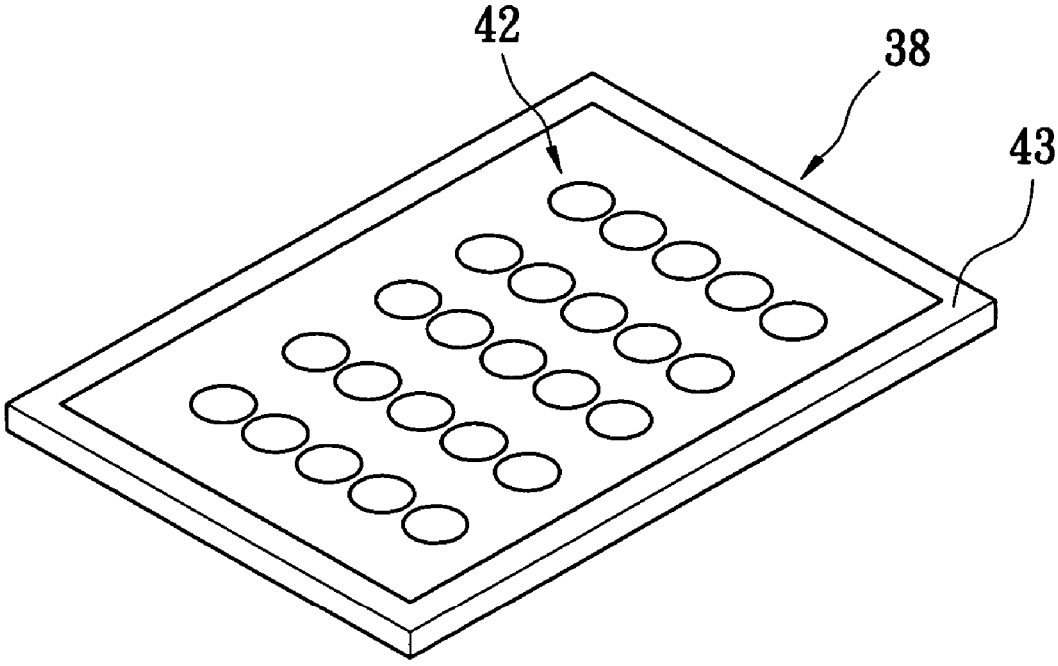
FIG. 5 is a perspective view of a conventional supporting device.

An FED disclosed in FIG. 4 according to the invention includes a cathode 20, an anode 10 and an insulating supporting device 38. The cathode 20 has a plurality of cathode ribs 24, a plurality of cathode electron emitter layers 23, a cathode electrode layer 22 and a cathode glass substrate 21. The anode 10 has a plurality of anode ribs 14, an anode conductive layer 12, a phosphors layer 13 and an anode substrate 11. The insulating supporting device 38 illustrated in FIG. 4 is used for supporting the cathode 20 and the anode 10, and has a reflection layer 44 and a gate conducting line 4*b*. The cathode ribs 24 are alternately arranged with the cathode electron emitter layers 23. The cathode electrode layer 22 consists of parallel cathode conductive lines. The cathode conductive lines of the cathode electrode layer 22 are orthogonal to the gate conductive lines 46 that is parallel to one another. A cathode electron emitter material is arranged on the cathode conductive lines as the cathode electron emitter layer 23. The reflection layer 44 is arranged on a side of the insulating supporting device 38 to correspond to the anode 10 for light reflection.

Figure 1:
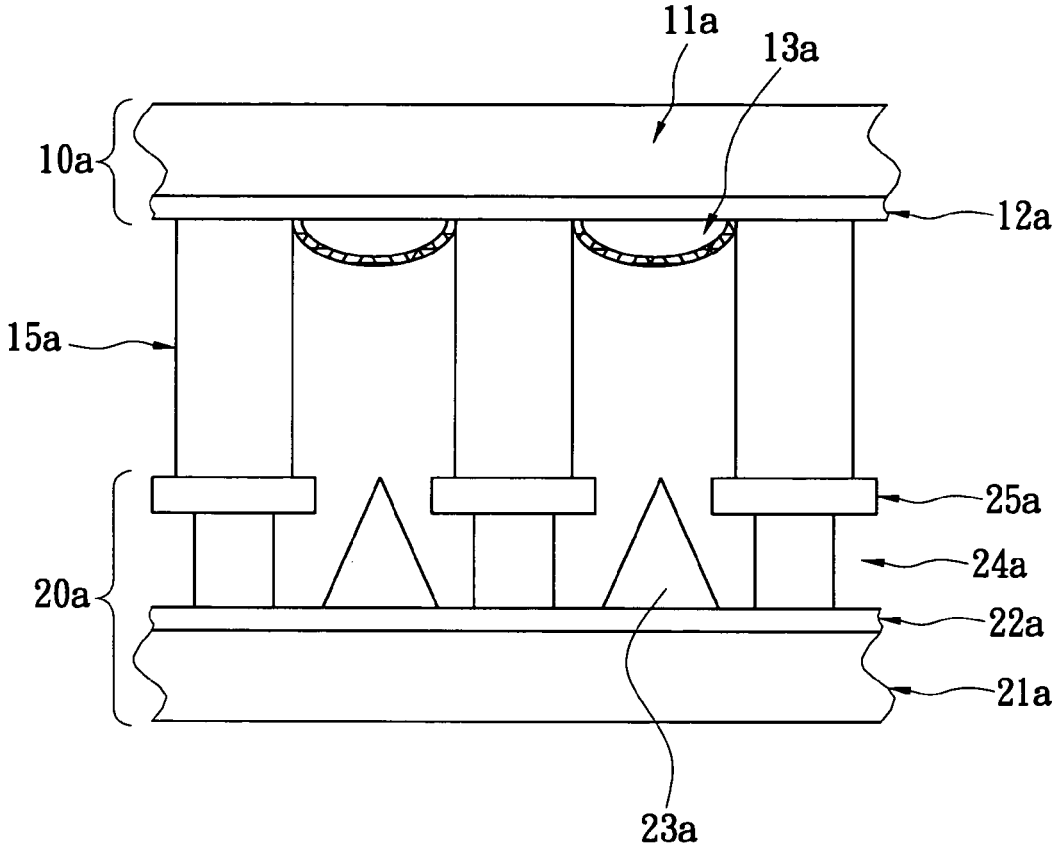
FIG. 1 PRIOR ART
FIG. 1 is a cross-sectional profile of a conventional FED.
Figure 2:
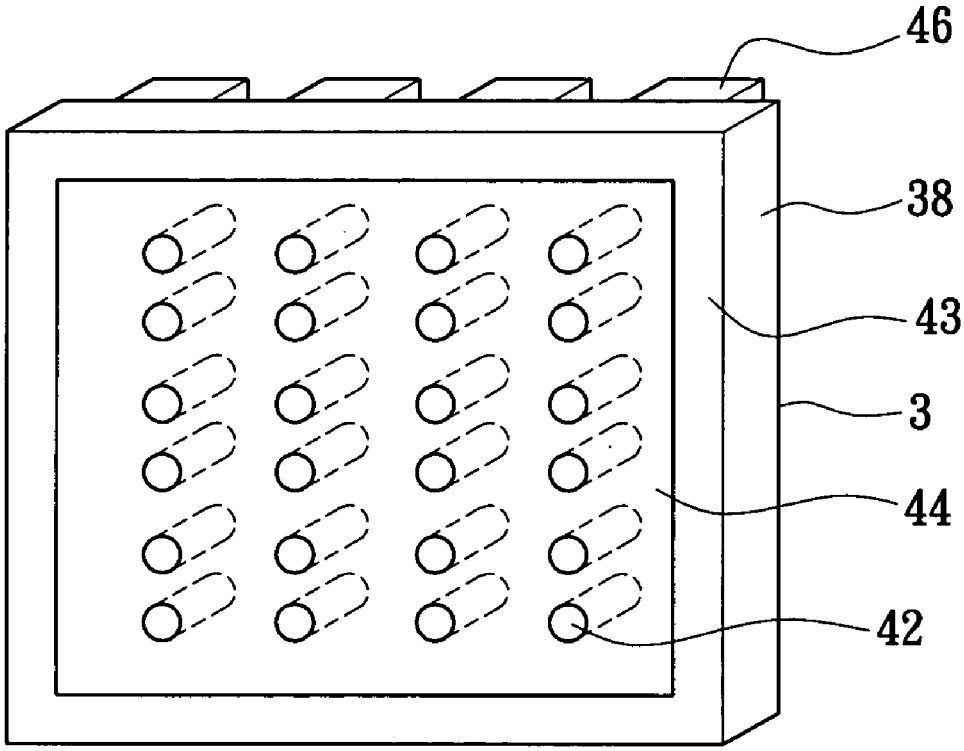
FIG. 2 is a perspective view of a gate-supporting device with a reflection layer according to the present invention.
Figure 3:
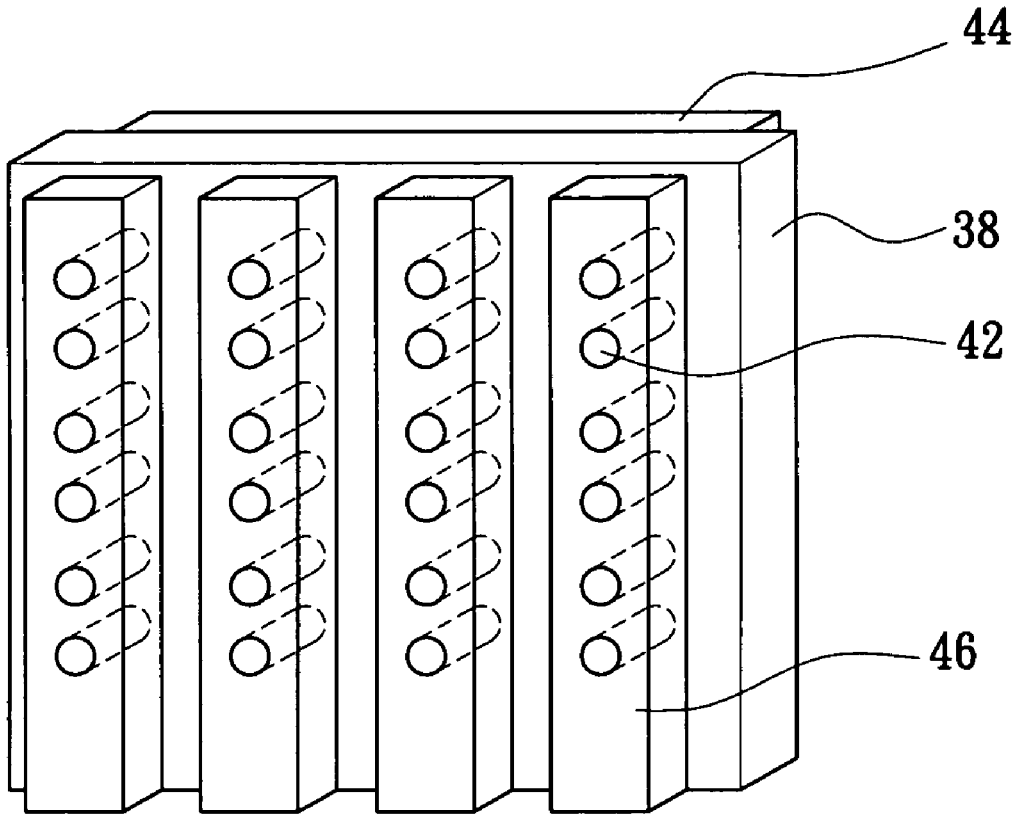
FIG. 3 is a perspective view of another embodiment of the present invention.

With respect to FIG. 2, the insulating supporting device 38 includes a plurality of apertures 42 formed thereon, and the apertures 42 provide a cavity for relative electrons in the FED. Because the reflection layer 44 is arranged to correspond to the anode to reflect the light from the phosphors layer 13, the luminance is increased, and a periphery surrounding the reflection layer is an ineffective area used for sealing and alignment. The gate is arranged on an opposite side of the supporting device 38 and made of conductive materials in a sprinting, spreading or etching manner. The gate consists of the gate conductive line 46 in which the apertures 42 are formed. The anode ribs 14 relates to the apertures 42 as a plurality of passageways formed between the anode ribs 14 and communicating with the apertures 42, respectively.

The reflection layer can be made by sputtering or evaporation on a side of the supporting device 38 by a glass substrate with apertures 42. On an opposite side of the glass substrate, the gate is made by screen-printing or spreading.

The steps of making the FED includes making a plurality of cathode ribs 24 and anode ribs 14 respectively disposed on the cathode electron emitter layer 23 of cathode 20 and the phosphors layer 13 of the anode 10. The cathode ribs 24 and the anode ribs 14 are arranged between the reflection layer 44 and the gate, and adjacent to the apertures 42. Glue (UV glue) and a binder are applied to a predetermined position of the ineffective area 43 (see FIG. 11) to false-connect the supporting device 38 between the cathode 2 and the anode 1. After a sintering process, the UV glue, such as a glass glue, can be removed by oxidization to secure the supporting device 38. The insulating supporting device 38 are aligned with high precision via alignment structures. The unit of the anode 10 and the cathode 20 can align with the apertures. The false-connect process or clamping equipment can be adopted after the alignment process. The semi-finished product after false connection is then sintered in order to secure the supporting device 38 between the anode 1 and the cathode 2.

The materials with similar expansion coefficients will increase the precision of the alignment between the cathode 20 and the anode 10.

For further detailed description, the reflection layer 44 is arranged between the insulating glass substrate 38- and the anode ribs 24 and faces the phosphors layer 11. The phosphors layer 11 is made by screen-printing or spreading. The cathode electron emitter layers 23 are made by screen-printing or spreading. Each of the cathode electron emitter layers 23 includes a plurality of property-improving carbon nanotubes (like dotting carbon nanotubes) and is capable of high electron emission efficiency. The insulating supporting device 38 has a plurality of apertures 42 formed in the reflection layer 44, and each of the cathode electron emitter layers is formed on each of the apertures 42. A plurality of passageways is formed among the anode ribs 14 to communicate with the apertures 42. The reflection layer is made of aluminum or chromium. The cathode ribs 24 are fabricated by photolithography or screen-printing. The cathode ribs 24 are used for spacing from the gate and the cathode electronic layer 22. The gate can be made by thick-film printing etching, or etching. An adhesive with glass is provided and is capable of connecting the anode 10 and the cathode 20 after a sintering process. The insulating supporting device 38 has an expansion coefficient ranging from $10^{-6}$ to $10^{-7}$ per degree centigrade. The cathode ribs 24 have a thickness ranging from 50 μm to 100 μm. Each of the cathode ribs 24 has a thickness ranging from 30 μm to 60 μm to match the cathode electron emitter layer 23. The insulating supporting device 38 has an expansion coefficient ranging from $82\times10^{-6}$ to $86\times10^{-7}$ per degree centigrade. The cathode ribs 14 and the cathode ribs 24 are made of glass, and haye expansion coefficients ranging from $82\times10^{-6}$ to $86\times10^{-7}$ per degree centigrade. The driven power is designed as 80 voltages.

The present invention is characterized by an easy manufacturing process, mass production, low costs and less equipment.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. An FED comprising:

a) a cathode substrate;

b) an anode substrate spaced apart from the cathode substrate a predetermined distance forming a gap there between;

c) a cathode electrode formed on the cathode substrate;

d) a plurality of cathode electron emitter layers contacting the cathode electrode, wherein each of the cathode electron emitter layers is formed by one of screen-printing and spreading;

e) an anode electrode formed on the anode substrate;

f) a plurality of phosphor layers formed on the anode electrode, wherein each of the phosphor layers is formed by one of screen-printing and spreading;

g) a plurality of cathode ribs located on the cathode substrate;

h) a plurality of anode ribs located on the anode substrate; and i) an insulating supporting device located in the gap between the cathode ribs and the anode ribs, the insulating supporting device having a reflection layer formed on a top thereof reflecting light emitted from the phosphor layers and a gate conductive line formed on a bottom thereof.

2. The FED according to claim 1, wherein each of the cathode electron emitter layers includes a plurality of carbon nanotubes.

3. The FED according to claim 1, wherein the supporting device has a plurality of apertures aligning with the phosphor layers and the cathode electron emitter layers, respectively.

4. The FED according to claim 1, wherein the reflection layer is made of aluminum or chromium.

5. The FED according to claim 1, wherein the cathode ribs and the anode ribs are made of glass, and have expansion coefficients ranging from about $82\times10^{-6}$ to $86\times10^{-7}$ per degree centigrade.

6. The FED according to claim 1, further including an adhesive with glass materials and capable of connecting the anode and the cathode after a sintering process.

7. The FED according to claim 1, wherein each of the anode ribs has a thickness ranging from about 50 μm to 100 μm.

* * * * *